United States Patent [19]

Wilke

[11] Patent Number: 4,739,537

[45] Date of Patent: Apr. 26, 1988

[54] DOOR HANDLE ARRANGEMENT

[76] Inventor: Rudolf Wilke, Marsbergerstr. 2, 3548 Arolsen, Fed. Rep. of Germany

[21] Appl. No.: 834,176

[22] Filed: Feb. 26, 1986

[30] Foreign Application Priority Data

Mar. 1, 1985 [DE] Fed. Rep. of Germany ..... 3507359

[51] Int. Cl.[4] ..... A47B 95/02

[52] U.S. Cl. ..... 16/121; 292/355; 24/136 R

[58] Field of Search ..... 16/118, 121, DIG. 30, 16/DIG. 24; 292/349, 353, 355; 74/527, 531; 24/13 RR

[56] References Cited

U.S. PATENT DOCUMENTS

| | | | |
|---|---|---|---|
| 1,487,496 | 3/1924 | Wentworth | 292/355 |
| 1,720,037 | 7/1929 | Entwistle | 24/136 R |
| 1,951,188 | 3/1934 | Flaherty | 292/349 |
| 2,316,918 | 4/1943 | Wallace | 16/121 R |
| 3,758,922 | 9/1973 | Field | 24/13 R |
| 3,776,586 | 12/1973 | Ahlgren | 24/136 R |
| 4,340,997 | 7/1982 | Voss | 24/136 R |

FOREIGN PATENT DOCUMENTS

| | | | |
|---|---|---|---|
| 102395 | 11/1937 | Australia | 292/349 |
| 1066725 | 4/1967 | United Kingdom | 292/349 |

*Primary Examiner*—Kurt Rowan

*Attorney, Agent, or Firm*—Townsend & Townsend

[57] ABSTRACT

A door handle arrangement has a bearing member (14) with a door handle bore (43) for mounting to the door leaf and also a door handle with a neck (11) which is axially inserted into the door handle bore (43). Conical segments (18) which are arranged around the neck (11) of the door handle are provided between the bearing member (14) and the neck (11) of the door handle. The conical segments have a conical outer peripheral surface and/or a conical inner peripheral surface, which cooperates in axially sliding manner with a corresponding complementary shaped counter-surface of the bearing member (14) and/or of the rotary spigot (12), and are biased axially by springs (15) in a direction which reduces the diameter of the opening which receives the neck of the door handle.

26 Claims, 11 Drawing Sheets

Figure 2:
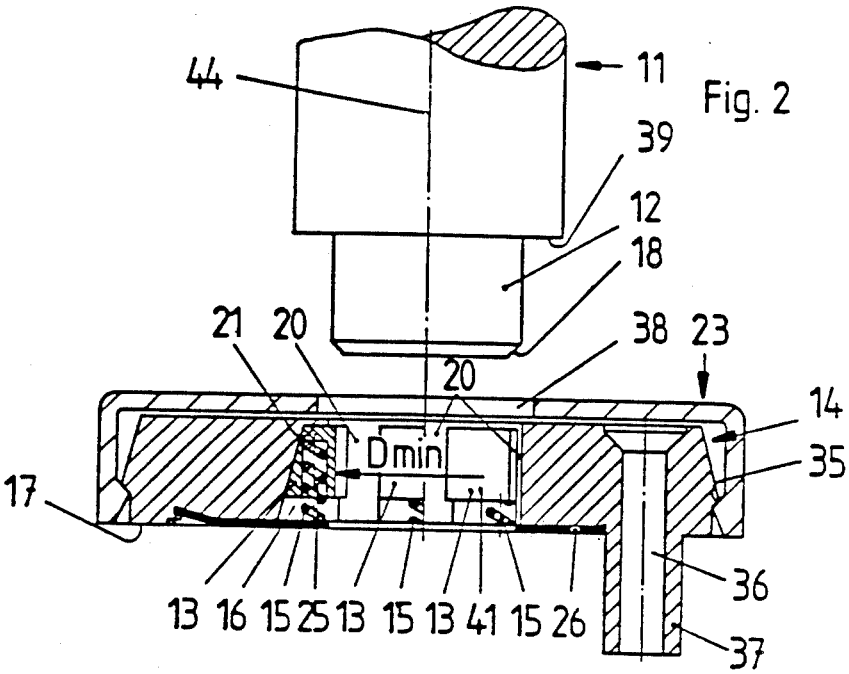

Fig. 9
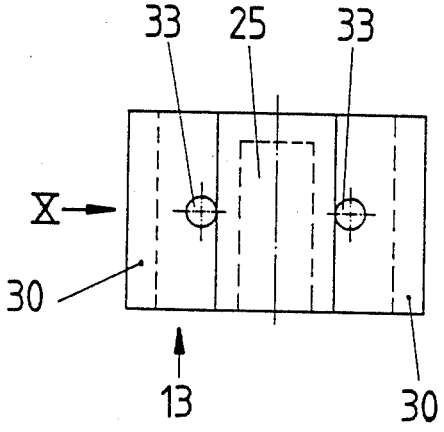
Fig. 10
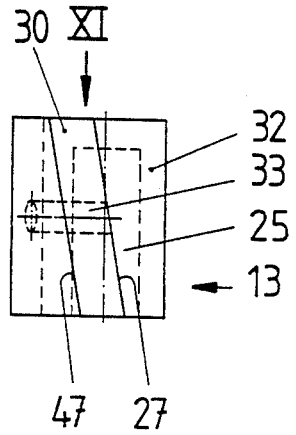
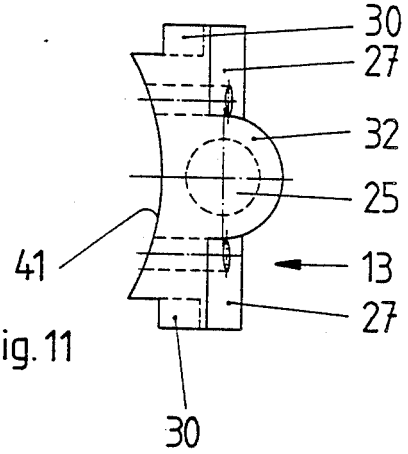
Fig. 11

DOOR HANDLE ARRANGEMENT

The invention relates to a door handle arrangement comprising a bearing member which is to be fastened to a door leaf, the bearing member having a door handle bore; a door handle having a neck which is axially inserted into said bore; and radially movable bearing means arranged between the bearing member and the neck of the door handle to rotationally journal the door handle at the bearing member so as to compensate for diametrical tolerances and/or concentricity errors and/or alignment errors.

Floating joint bearings are known for the purpose of compensating for alignment errors. A further known bearing (German Pat. No. 19 07 434, German Pat. No. 24 12 061) is adjustable in such a way that diametrical errors, concentricity errors and also alignment errors between the rotary spigot of the neck of the door and the bearing member can be compensated for. This previously known bearing arrangement has however the disadvantage that an accurate adjustment must be effected by the operator during installation if a playfree mounting of the door handle is to be ensured on the one hand, and if the clamping friction between the rotary spigot and the bearing part is not to be too large on the other hand.

The problem underlying the present invention is in contrast to provide a door handle arrangement of the initially named kind in which a playfree but nevertheless low friction mounting of the neck of the door handle is automatically ensured, and indeed even if the components that are used have certain diametrical tolerances and if certain concentricity and alignment errors arise due to misalignment during installation.

In order to solve this problem the invention provides that the radially movable bearing means comprise conical segments arranged around the rotary spigot of the neck of the door handle said conical segments having at least one conical outer surface, preferably a conical outer peripheral surface, and/or at least one conical inner surface, preferably a conical inner peripheral surface; that the conical segments are axially slidably arranged at at least one corresponding counter-surface of complementary shape of the bearing member and/or of the rotary spigot and are biased axially by springs in the direction of a reduction of the diameter of the door handle receiving opening, with the optionally non-conical outer or inner peripheral surface and the counter-surface of the bearing member and/or of the rotary spigot in contact therewith being of right-cylindrical shape.

In this way it is ensured that the conical segments always provide a playfree mounting on all sides of the rotary spigot.

In an extreme case a single conical segment would also be sufficient for the playfree mounting of the door handle if this should be desired for reasons of simplification in certain door handle arrangements.

In accordance with the invention the conical segments are held and guided in such a way that they can preferably neither fall out in the radially inward direction nor in the forward direction when in their position corresponding to the smallest diameter.

It is particularly preferable if the cone angle and the surface nature of the mutually sliding conical surfaces are so selected that on lack of contact at the internal and external peripheral surfaces the conical segments are just pushed by the preferably weak springs into the conical gap into contact with the inner and outer peripheral surfaces, but that the radial forces exerted by the rotary spigot are not able to axially displace the conical segments. This embodiment is particularly important because it results in a self-locking effect which makes a particularly friction-free mounting of the neck of the door handle possible, which is nevertheless radially fixed and free of play. The cone angle preferably lies between 10° and 20°. In order to obtain the largest possible radial compensation or equalisation the cone angle should be as large as can just be reconciled with achieving reliable self-locking.

In order to obtain a uniform mounting on all sides several and preferably four individual conical segments should be uniformly distributed around the neck of the door handle. In particular each individual conical segment should extend over an angle from 40° to 80°, preferably 50° to 70° and in particular of approximately 60°.

It is of particular importance when the conical gap opens up from the front side of the bearing member towards the rear surface.

In this way it is ensured that the rotary spigot of the neck of a door handle inserted from the front displaces the conical segments rearwardly in the direction of the door leaf until the chamber for receiving the rotary spigot as defined by the inner peripheral surfaces of the conical segments has reached the required diameter. The rotary spigot then penetrates into the chamber intended to receive it, and is surrounded on all sides by the conical segments in a sliding seat, but without play.

In order to facilitate insertion of the rotary spigot of the neck of the door handle a further embodiment is constructed in such a way that the rotary spigot of the neck of the door handle has a chamber at its entry end face by means of which the conical segments which have been displaced by the springs to the narrowest diameter of the door handle receiving opening can be pressed apart to the required diameter on axial insertion of the rotary spigot.

In a further preferred alternative the "conical" segments are of wedge-like tapering shape and preferably each have projecting sliding ribs at both sides in the peripheral direction, with the sliding ribs being flush with the preferably planar outer peripheral surface of the associated wedge-like segment and engaging with a sliding seat or with some play in complementary inclined grooves which are provided in the radial surfaces provided at the two peripheral sides of the associated "conical" (tapering) gap provided to accommodate the respective wedge-like segment. This embodiment avoids in particular the danger of the conical segments falling out in a radially inward direction.

In order that the internal peripheral surfaces of the conical segments are in uniform contact with the rotary spigot of the neck of the door handle when alignment errors are present a particularly preferred embodiment envisages that the conical segments have an axial extension at the inner peripheral surface such that, on the occurrence of alignment errors, the inner surface of the conical segments fully contacts the outer peripheral surface of the rotary spigot and the partial lifting of the conical segments brought about by the alignment errors occurs at their outer peripheral surfaces.

In order that the conical segments are not moved with the door handle in the peripheral direction by the frictional forces, which are admittedly small but nevertheless present, the conical segments should be axially displaceably journalled on the bearing member but nevertheless fixed in the peripheral (circumferential) direction.

In order, in the event of failure of one or more clamping segments, for example by breakage of the spring or of the segment, to retain a mounting of the door handle which is admittedly subject to a certain amount of play but which avoids a strongly eccentric or misaligned position of the door handle, a further embodiment of the invention provides for fixed segments of the bearing member to be arranged between the conical segments, with the fixed segments being set back somewhat in the radially outward direction.

In order to ensure that the conical segments adopt a clear initial position, also with pretensioned axial springs, axial abutments are preferably provided at the ends of the conical segments remote from the springs.

A further advantageous embodiment of the invention is constructed so that openings are provided in the front end face of the bearing member through which the conical segments can be axially loaded and displaced by means of a pin or screwdriver, optionally when the cover cap is removed, but with the neck of the door handle inserted. In this way the adaptation of the door handle position to the various errors can be assisted by axial displacement of the conical segments from the front end face of the bearing member.

Although the slide surface at the rotary spigot of the neck of the door handle can also be of conical shape it is however preferable for the rotary spigot and the inner peripheral surface of the conical segments to be of right-cylindrical shape and for only the outer peripheral surface of the conical segments and also the associated counter-surface of the bearing part to be of conical shape. In this way normal door handles with right-cylindrical spigots at the neck region can be used with the bearing member of the invention.

It is expedient for space saving mounting of the springs if the conical segments have axial blind bores in which the springs are arranged in the form of compression coil springs.

In order to support the springs at the bearing member the springs are preferably supported at the end which faces axially away from the conical segments on a ring plate mounted at the rear surface of the bearing member.

An embodiment which is particularly suitable for practical realisation is characterised in that the conical segments have partial peripheral surfaces which extend obliquely to the axis solely at their two end regions in the peripheral direction, with each of the part peripheral surfaces cooperating with a corresponding flank of a respective one of two inclined grooves arranged at the side in the bearing part. In this arrangement provision should in particular be made for the part peripheral surfaces to be formed on sliding ribs disposed at the sides of the conical segments and guided in a sliding seat in the inclined grooves.

Furthermore, it is expedient if a free space is provided in the bearing member radially outside of each conical segment between the inclined grooves, with a spring accommodating projection of the conical segment being arranged between the sliding ribs and extending into the free space.

In this way the conical segments are clearly guided on all sides over their entire displacement path. In order to ensure automatic lubrication even over a long period of operation the conical segments can have bores or grease deposits in the sliding surfaces.

An ideal adaptation, in particular to concentricity and alignment errors is ensured in a particularly favourable manner by keeping the conical segments separate from each other because each conical segment can adopt a different axial position.

It is however also possible to combine the conical segments into a conical ring provided with a peripheral slot. In this case the conical ring must be made sufficiently resilient that it can accommodate partial deflections, such as occur with the presence of alignment and concentricity errors, without problem.

The torsional deflection of the conical ring is substantially facilitated if the conical ring is provided with axial slots between adjacent conical segments with the axial slots being open at one end. With this arrangement it is particularly advantageous if the axial slots are alternately open to the one and to the other end face of the conical ring.

If the bearing part is provided with a cover cap then attention must also be paid to compensating for different radial positions of the door handle in this area.

If one is concerned with a door handle arrangement with a cover cap which covers over the bearing member and which can preferably be snapped into place, with the cover cap having a bore for the passage of the door handle in alignment with the door handle bore of the bearing member, and with the rotary spigot at the neck of the door handle having the same diameter as the projecting part of the neck of the door handle then the invention provides, in accordance with a particular preferred embodiment, that the locking surfaces of the cover cap are formed with sufficient radial overlap that the cover cap can be radially displaced on the bearing member by the amount required for radial equalisation of the conical segments on the bearing member, with the hole in the cover cap for the passage of the neck of the door handle having a diameter corresponding essentially to the outer diameter of the neck of the door handle or of the rotary spigot. However, if one is in contrast concerned with a door handle arrangement with a cover cap which covers over the bearing member and which can preferably be set into place with the cover cap having a hole for the passage of the door handle in alignment with the door handle bore of the bearing member, and with the rotary spigot of the neck of the door handle having a smaller diameter than the part of the door handle neck which projects radially beyond the bearing member, and merging via a radial shoulder into said part of the door handle neck which projects axially from the bearing member, then the invention provides an arrangement for radial equalisation in the area of the cover cap such that the cover cap is radially fixed on the bearing member in such a way that the hole in the cover cap for the passage of the door handle has a larger diameter than the rotary spigot corresponding to the amount required for radial equalisation of the conical segments, with the ring shoulder covering the hole for the passage of the door handle in every possible radial position of the neck of the door handle.

Thus the self-locking of the conical segments is of particular importance in the present invention because this avoids the relatively weak springs which axially bias the conical segments having to carry bearing forces. Relatively weak springs are however also desirable for this purpose to avoid a large braking moment being exerted on the neck of the door handle or on the rotary spigot, which would lead to stiffness of movement of the door handle.

In order to reduce the braking effect between the rotary spigot and the bearing member the friction between the rotary spigot of the neck of the door handle and the conical segments should be kept as small as possible. This can be favourably influenced by an appropriate choice of material (for example polyamide for the neck of the door handle, polyoximethylene for the bearing ring) and by additional lubrication. For permanent lubrication grease deposits can be provided in the slide surfaces of the conical segments.

To the extent that the conical segments are combined into a conical ring it is expedient if this ring is put together layerwise from individual slotted disks or from ring segments which are capable of restricted movement relative to one another, approximately in a manner of a metallic watch strap.

In order, in an arrangement in which the conical segments are combined together into a conical ring, that the conical ring cannot rotate it is possible to provide a radial projection in the conical receiving bore of the bearing member which engages radially into the radial slot of the conical ring.

Through the provision of appropriate axial projections the invention ensures full area contact of the conical segments with the continuously moved sliding surfaces at the rotary spigot. The axial springs are selectedly or additionally arranged as far outwardly as possible on the conical segments and/or placed in an inclined position corresponding to the cone angle.

If, in accordance with a preferred embodiment, the conical segments are guided in inclined, for example T-shaped grooves, then the conical segments which are constructed as sliders are given a certain amount of play in the grooves perpendicular to the inclined faces so that they can tilt somewhat if alignment errors of the door handle are present, and can thus contact the rotary spigot of the neck of the door handle over the full area. It is also possible to extend the part of the conical segment which faces the rotary spigot of the neck of the door handle relative to the parts which are guided in the grooves, as has been generally described above in connection with the conical segments.

It is possible to arrange conical segments formed as individual parts closely alongside one another so that practically the total internal surface of the bearing consists of adjacent conical segments. It is also possible, if desired, to leave, between the sliders, segments of the bearing member which are set back radially somewhat and which limit the adjustability of the bearing and thus form a reserve bearing.

If openings are provided in the end face of the bearing member through which the conical segments are accessible so that they can for example be pushed rearwardly towards the door surface with the finger or with a screwdriver when the cover cap is moved, then it is possible to temporarily free the neck of the door handle in order to correct its centering or alignment.

Figure 1:
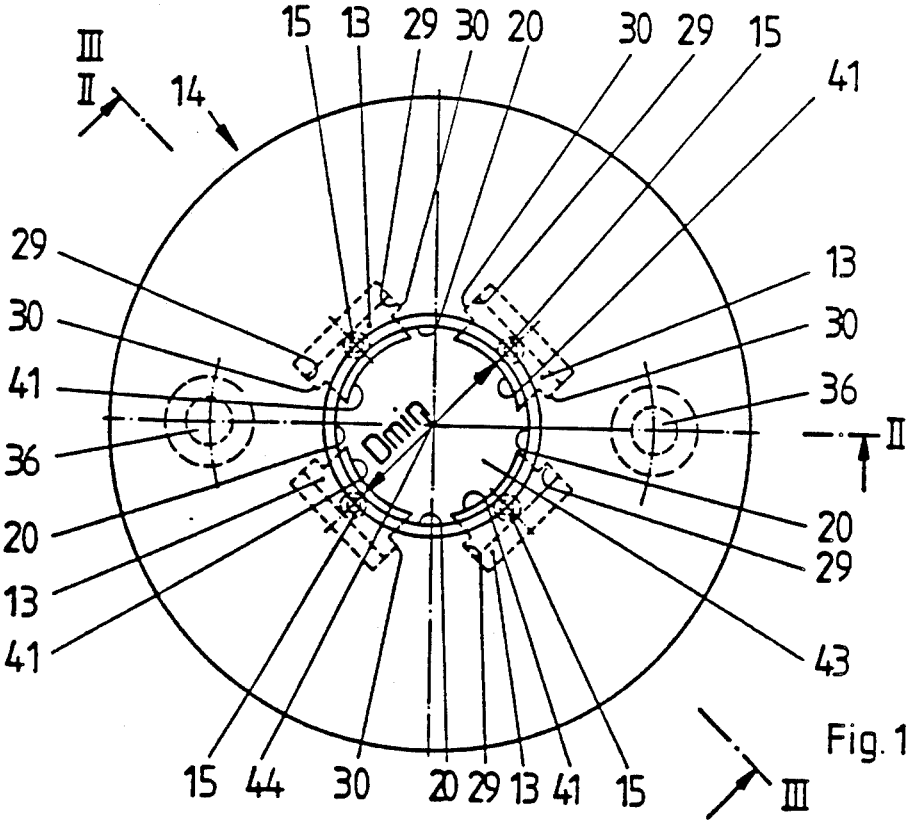
Figure 3:
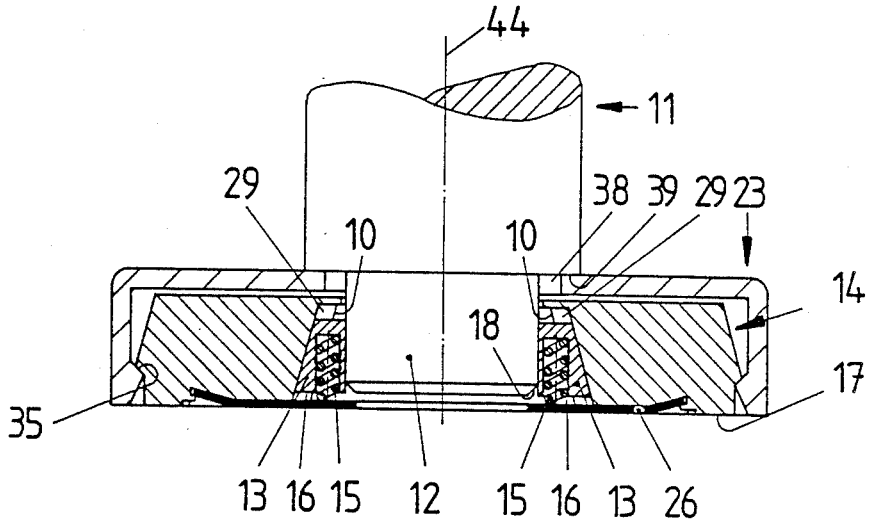
Figure 4:
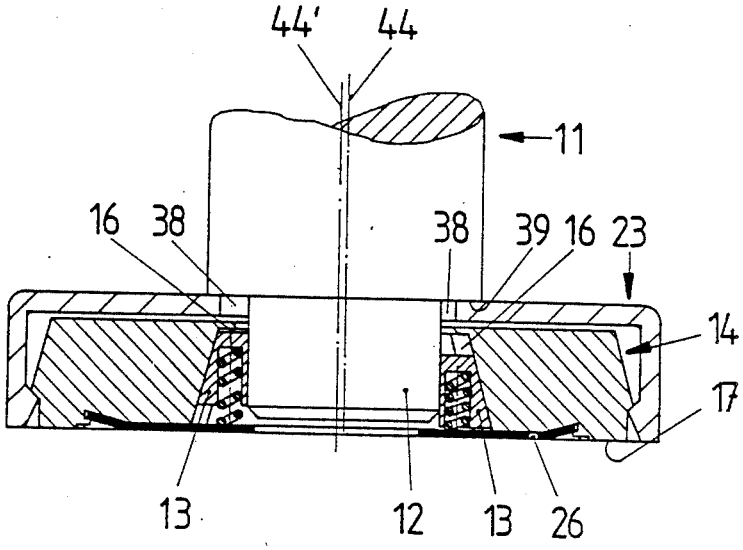
Figure 5:
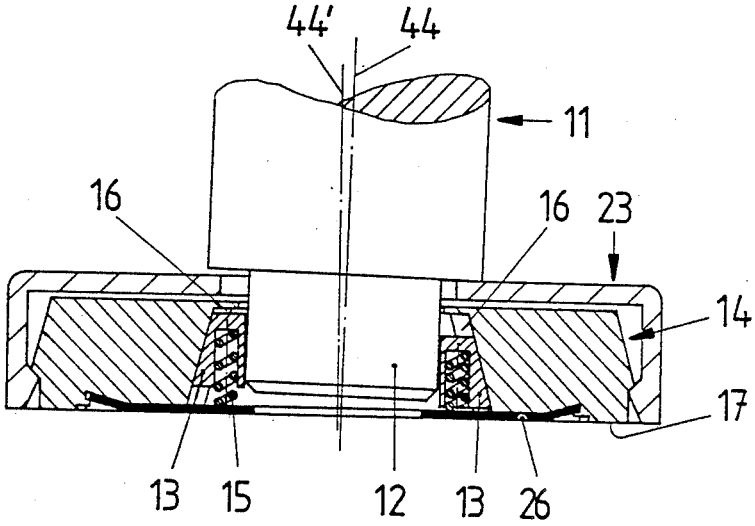
Figure 6:
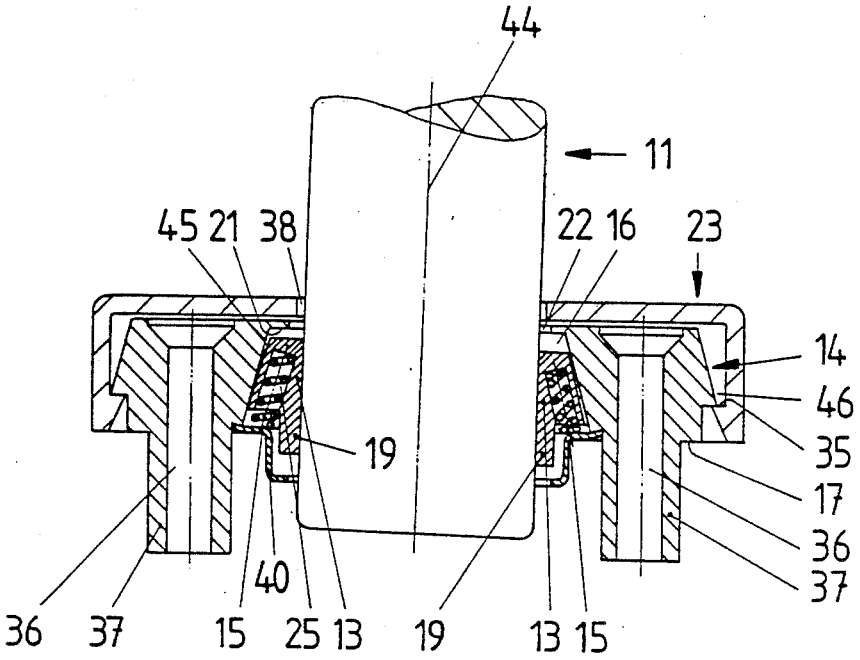
Figure 7:
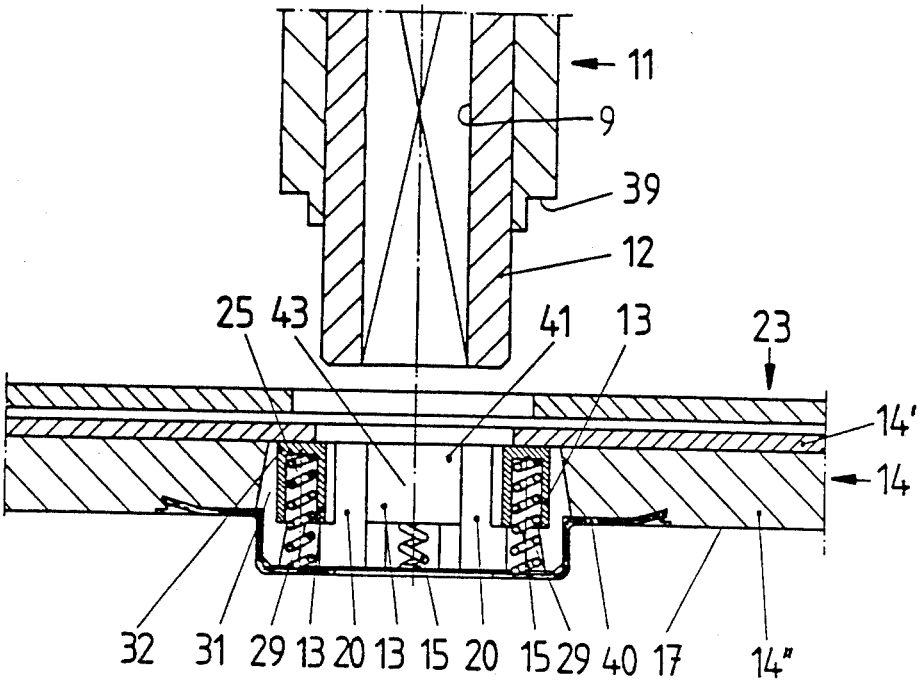
Figure 8:
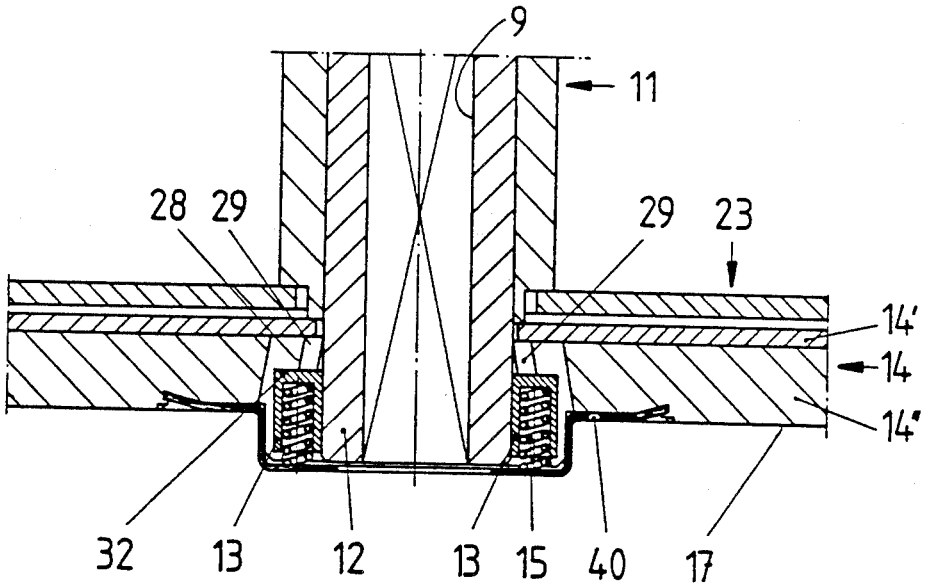
Figure 13:
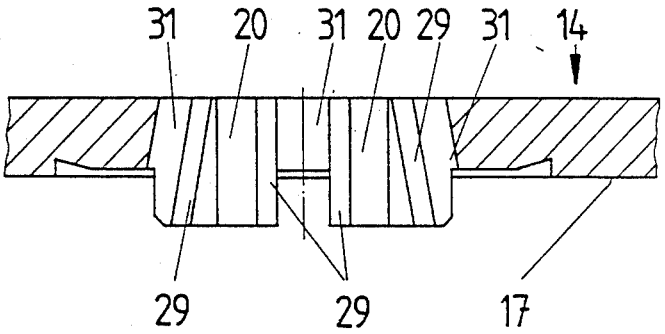
Figure 12:
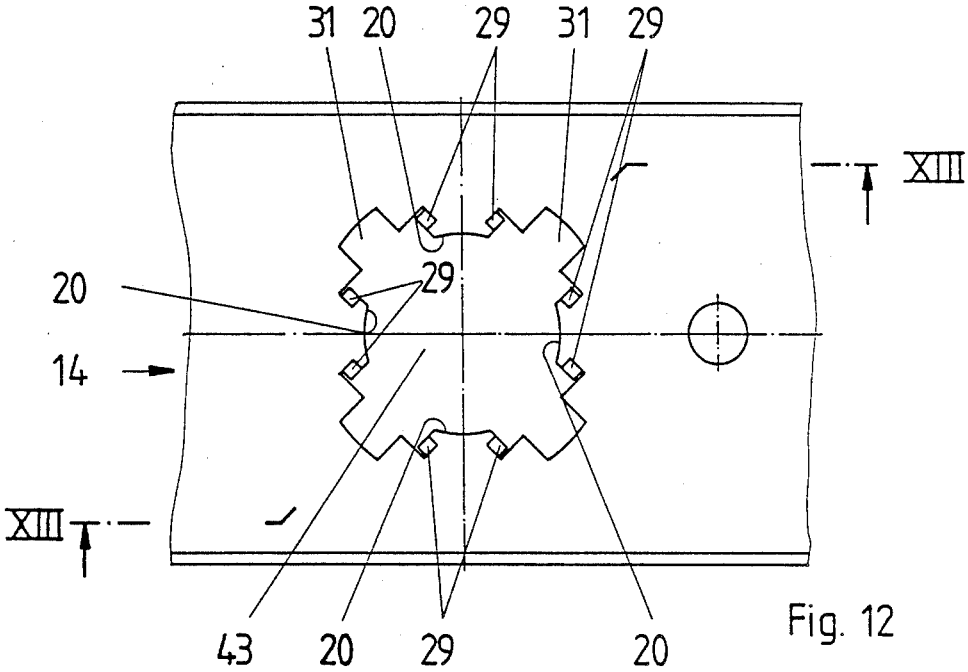
Figure 14:
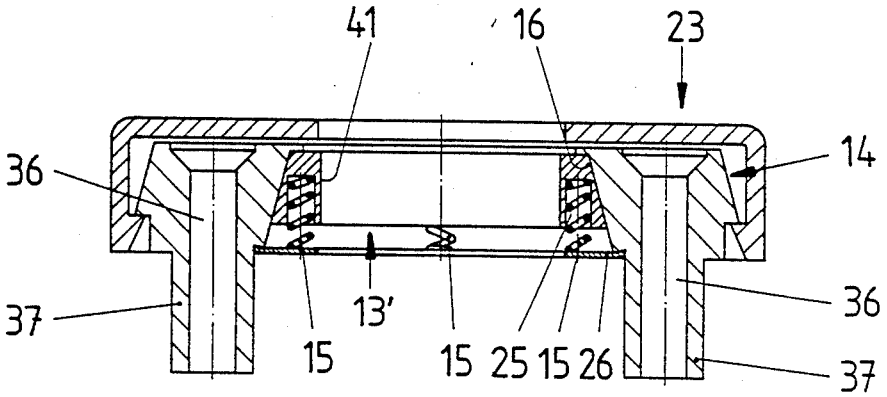
Figure 15:
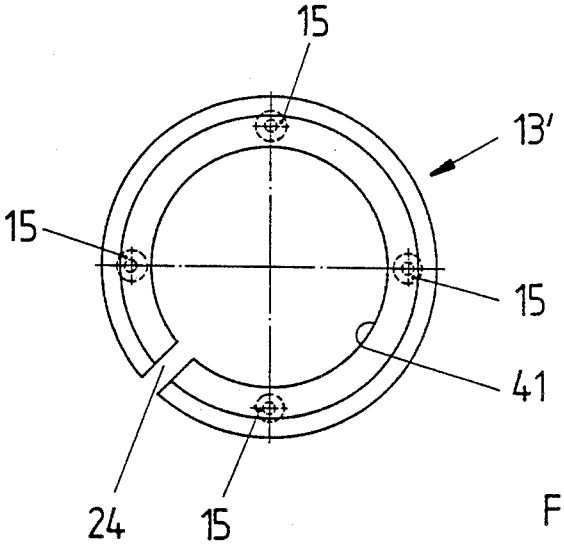
Figure 17:
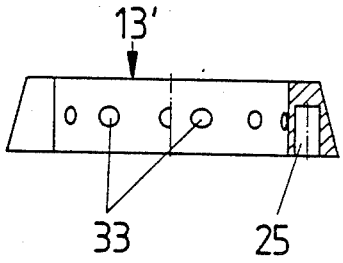
Figure 16:
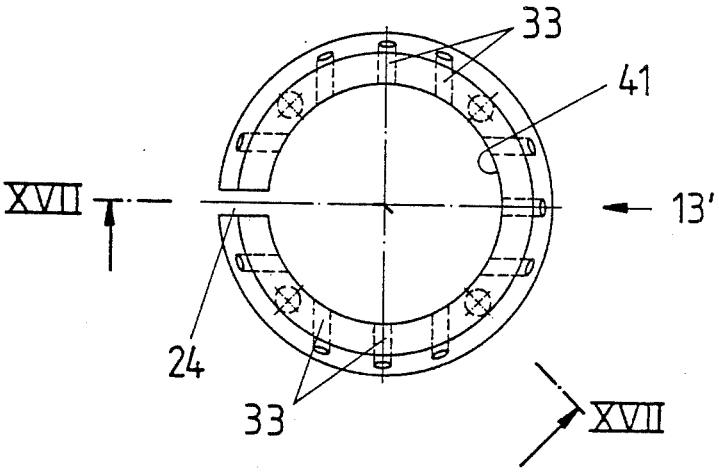
Figure 19:
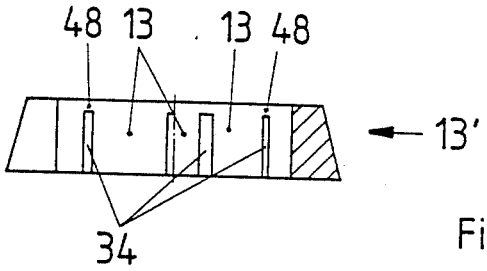
Figure 18:
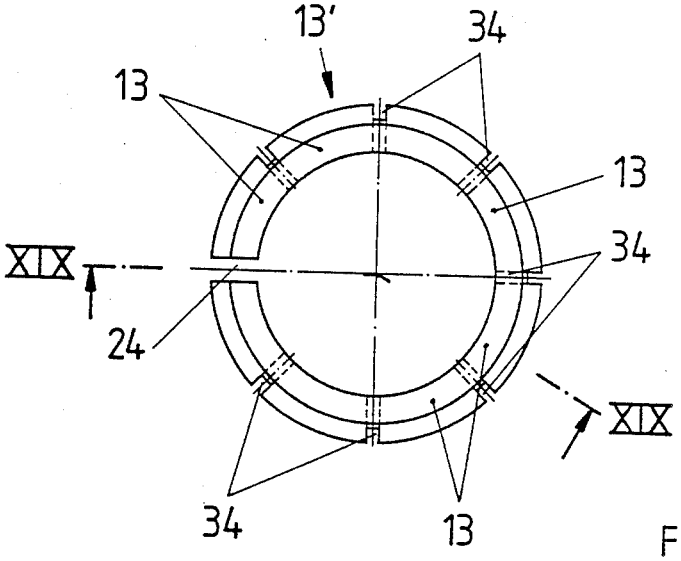
Figure 21:
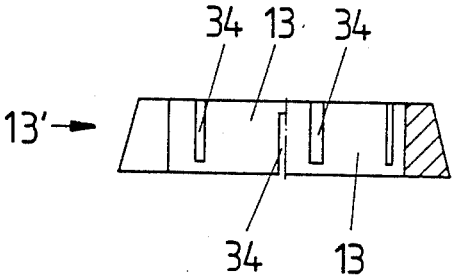
Figure 20:
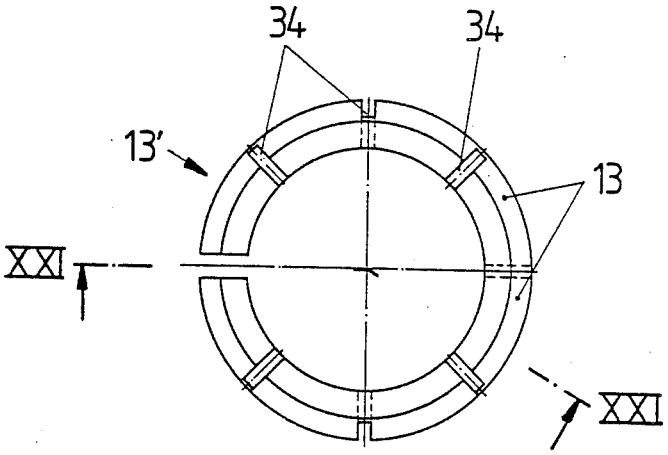
Figure 23:
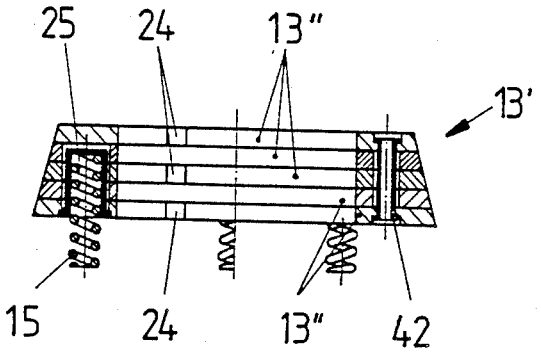
Figure 22:
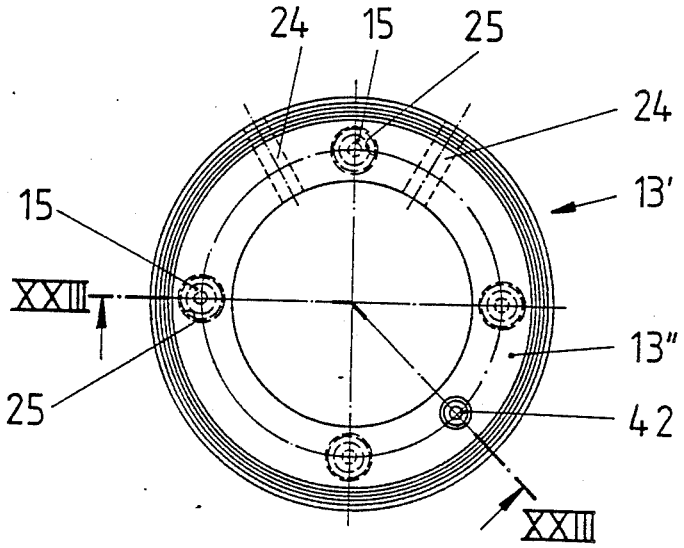

The invention will now be described in more detail by way of example only and with reference to the drawings which show:

FIG. 1. a schematic front view of a bearing member for a door handle arrangement in accordance with the invention, with the bearing member being constructed as a rose, FIG. 2 a section on the line II—II of FIG. 1 which also shows part of the door handle in the position before it is inserted into the bearing member, FIG. 3 a section on the line III—III of FIG. 1 which also shows part of the door handle after insertion into the bearing member, FIG. 4 a section analogous to that of FIG. 3 with a concentricity error present between the bearing member and the door handle, FIG. 5 a section analogous to FIG. 3 with an alignment error being assumed between the door handle and the bearing member, FIG. 6 a partially sectioned side view analogous to FIG. 3 of a further embodiment, FIG. 7 a section of a further embodiment of a door handle arrangement in accordance with the invention with a finger plate as the bearing member, with the door handle being shown shortly before it is inserted into the finger plate, FIG. 8 a section corresponding to that of FIG. 7 but with the door handle inserted, FIG. 9 a radial view of one of the conical segments used in the embodiment of FIGS. 7, 8, FIG. 10 a side view of the conical segment of FIG. 9 in the direction of the arrow X in FIG. 9, FIG. 11 a view of the conical segment of FIG. 9 in the direction of the arrow XI in FIG. 10, FIG. 12 a partial front view of the finger plate of the door handle arrangement of FIGS. 7, 8 without the inserted conical segments and with the cover cap and cover plate having been removed, FIG. 13 a section on the line XIII—XIII in FIG. 12, FIG. 14 a section analogous to FIG. 3 of a further embodiment with conical segments combined together into a ring, FIG. 15 a front view of the conical ring of the embodiment of FIG. 14 which has been put together from conical segments, FIG. 16 a front view of a further embodiment of a conical ring in accordance with the invention, FIG. 17 a section on the line XVII—XVII of FIG. 16, FIG. 18 a front view analogous to FIG. 15 of a further preferred embodiment of a conical ring in accordance with the invention, FIG. 19 a section on the line XIX—XIX in FIG. 18, FIG. 20 a front view analogous to FIG. 15 of a further embodiment of the conical ring of the invention, FIG. 21 a section on the line XXI—XXI in FIG. 20, FIG. 22 a front view of a further preferred embodiment of a conical ring in accordance with the invention, and FIG. 23 a section on the line XXIII—XXIII in FIG. 22.

As seen in FIGS. 1 and 2 a rose 14 which forms the bearing member of a door handle arrangement has securing bores 36 and also fitting spigots 37 which surround these bores and project towards the door leaf (not shown). The fitting spigots 37 are inserted into corresponding fitted bores of the door leaf. During mounting the rose 14 is placed with its rear surface 17 against the door leaf whereupon the final fixing of the rose to the door leaf is effected by means of screw inserted into the securing bores.

At the center the rose is provided with a door handle bore 43 which is bounded by an inner wall of the bearing member 14 consisting of individual segments 20. The diameter of the peripheral wall formed by the right-cylindrical segments 20 is so much larger than the diameter of the rotary spigot 12 of the neck 11 of a door handle, which is only shown broken away in FIG. 2, that the rotary spigot 12 is journalled with a distinct clearance or free play on all sides within the segments 20. The play between the segments 20 and the rotary spigot 12 in the radial direction is so large that it is possible to accommodate all the diameter variations which occur in practice as a result of manufacturing tolerances, and also all conceivable concentricity and alignment errors between the door handle and the rose 14.

Such concentricity and alignment errors are frequently encountered because the axially extending aperture 9 of the neck (shown in FIGS. 7 and 8) snugly fits over the shank or stem (not shown) of the lock to be operated by the door handle. This snug engagement of the handle determines its position relative to the bearing member and requires that resulting concentricity and alignment errors between the neck 11 and the handle bore 43 be compensated for.

In order to provide a playfree, low friction rotary mounting for the rotary spigot 12 despite this overdimensioning of the door handle bore 43 the bearing member 14 has conical ring gaps 16 between the segments 20 in the peripheral direction. These conical ring gaps 16 extend in just the same way as the segments 20 concentric to the axis 44 of the door handle but have however a conical outer peripheral surface which is radially outwardly displaced relative to the segments 20, with the conical ring gap 16 becoming broader from the side of the door handle towards the rear surface 17 of the rose 14.

Conical segments 13 are axially displaceably inserted into the conical ring gaps 16, with the conical outer peripheral surfaces of the conical segments extending complementary to the internal peripheral surfaces of the conical ring gaps 16.

Radially inwardly the conical segments have right-cylindrical internal slide surfaces 41, the right-cylindrical shape of which is complementary to the right-cylindrical shape of the rotary spigot 12.

The conical segments 13 are made shorter in the axial direction than the thickness of the rose 14 and are in each case biased from behind into the position shown in FIG. 2 at the start of the door handle bore 43 by an axially disposed compression coil spring 15. The springs are located in axial bores 25 at the rear side of the conical segments 13 and the rear ends of the springs are braced against a ring plate 26 which is secured into the rear surface 17 of the rose 14 and projects radially inwardly only to such an extent that the non-illustrated square section bar which interconnects the door handles on the opposite sides of the door can pass through unhindered.

In order to restrict the movement of the conical segments 13, which are axially biased in the direction towards the door handle, towards the front side of the rose 14 the conical ring gap 16 is partly axially restricted at the front side by axial abutments 21 which project radially inwardly over the conical segments 13. This is done in such a way that in the position which can be seen from FIGS. 1 and 2, prior to insertion of the rotary spigot 12, the conical segments come into contact with the axial abutments 21 as a result of the springs 15. In this position the internal slide surfaces 41 of all four conical segments which are arranged around a periphery at equal intervals define a minimum diameter Dmin for the reception of a rotary spigot 12 of a door handle which has the smallest diameter within the manufacturing tolerances. If a rotary spigot 12 of this kind is inserted into the bore defined by the inner slide surfaces 41 then it will be rotationally guided without play.

The axial abutments 21 should not project further inwardly in the radial direction than the segments 20 of the rose 14 which form a reserve bearing.

If now, in accordance with FIG. 3, a rotary spigot 12 with a larger diameter than the diameter Dmin is inserted axially into the door handle bore 43 then a chamfer 18 provided at the rear end of the rotary spigot 12 contacts the front ring-like flat end faces of the conical segments 13 and displaces the latter in the direction towards the rear surface 17.

During this the conical segments 13 are pressed rearwardly under the action of the forces exerted via the chamfer 18 so that the conical segments 13 slide along the conical inner peripheral surface at the conical ring gap 16 and the radial spacing of the internal slide surfaces 41 from the axis of rotation 44 becomes larger, i.e. the actual diameter of the door handle bore 43 which is defined by the internal slide surfaces 41 becomes continuously larger. This displacement process of the conical segments 13 continues until the diameter defined by the inner slide surfaces 41 has reached the value of the outer diameter of the rotary spigot 12 of the inserted neck 11 of the door handle. The rotary spigot 12 can now enter into the space between the conical segments 13 and finally adopt the position shown in FIG. 3.

The door handle is now journalled without play in the rose 14.

The conical segments 13 are also extended in the peripheral direction at both sides by slide ribs 30 which are inclined in correspondence with the conical gap 16. The slide ribs 30 are journalled in inclined grooves 29 with a sliding seating or with play which makes a certain degree of tilt equalisation possible. The inclined grooves 29 are provided in radial surfaces at the peripheral ends of the conical ring gap 16.

In accordance with the invention the cone angle of the conical ring gap 16 should be sufficiently small that self-locking occurs when radial forces are exerted on the conical segments 13 via the rotary spigot 12. In this case displacement of the conical segments 13 in the direction of the rear surface 17 should be precluded even when using very weak springs 15. As a result of this construction the friction between the inner slide surfaces 41 and the rotary spigot 12 can be kept very small while on the other hand radial deviation of the rotary spigot 12 is precluded even when large forces act on the door handle.

Prior to insertion of the door handle into the rose 14 a covering cap 23 is snapped into position on the rose 14 by means of latch surfaces 35 provided at the periphery.

The cover cap 23 has a central bore 38 for the passage therethrough of the door handle, and the bore 38 has a diameter which is larger than the smallest possible diameter of the rotary spigot 12 by an amount such that the rotary spigot does not abut against the internal edge of the hole 38 for all the possible diameter variations, concentricity and alignment errors. This type of play compensation between the neck 11 of the door handle and the cover cap 23 is preferred when, as can be seen from FIGS. 2 and 3, the rotary spigot 12 has a smaller diameter than the part of the neck 11 of the door handle which projects axially beyond the rose 14. In this way a flat annular step or shoulder 39 is provided which extends in the radial direction, which contacts the front side of the cover cap 23 and which completely covers over the clear ring gap between the rotary spigot 12 and the peripheral edge of the hole 38 for the passage of the door handle from the front side. The prerequisite is that the annular step 39 has a sufficient extent in the radial direction that the hole 38 for the passage of the door handle is in every case covered over in the context of the predetermined compensation.

In all further figures the same reference numerals are used to designate parts which correspond to parts already discussed in connection with FIGS. 1 to 3.

FIG. 4 shows the same embodiment as FIGS. 1 to 3 however the central axis 44 of the neck 11 of the door handle is displaced relative to the central axis 44' of the rose 14 of FIG. 4 to the right by approximately 0.5 mm. This concentricity error is straightforwardly balanced out by the door handle arrangement of the invention in as much as the conical segment 13 relative to which the rotary spigot 12 is somewhat displaced is deflected further in the axial direction than the diametrically oppositely disposed conical segment 13.

The rotary spigot 12 admittedly does not contact the two diametrically oppositely disposed conical segments 13 which are not illustrated in FIG. 4 along a precise circle, however these relatively small deviations can be compensated for without problem by the elasticity of the rotary spigot 12 and of the conical segments 13, or of their support at the inner peripheral surface of the conical ring gap 16.

As seen in FIG. 5 the central axis 44 of the door handle is tilted through a small angle of approximately 2° to 3° relative to the central axis 44' of the rose 14, and indeed towards the right in FIG. 5. In this case the conical segments 13 which are displaced to a greater or lesser degree in the axial direction also provide the requisite compensation, with playfree guidance of the rotary spigot 12 being guaranteed now as previously. A small partial lifting of the slide surfaces on the rotary spigot 12 from the inner slide surfaces 41 is on the one hand partly compensated for by resilient yielding of the components, which preferably all consist of synthetic (plastic) material, and does not make the proper functioning of the door handle mounting questionable. On the other hand, the conical segments 13 can. also partially lift somewhat from the peripheral surfaces, so that even, with maximum alignment errors, virtually full radial support of the rotary spigot 12 is on the whole ensured.

In the embodiment of FIG. 6 the compression coil springs 15 which act on the conical segments 13 and the bores 25 which accommodate them are arranged inclined to the door handle bore, and indeed at the angle of the conical inner peripheral surface of the conical ring gap 16. In this way the force acting on the conical segments 13 is exerted exactly in the direction of movement of the conical segments 13.

Moreover, the embodiment of FIG. 6 has the special feature that the conical segments 13 have axial extensions 19 in the direction towards the door leaf (not shown) which are in sliding and guiding engagement with the outer peripheral surface of the rotary spigot 12 of the neck 11 of the door handle. The axial extensions 19 project significantly beyond the rear abutment for the springs 15 in the region of the rear surface 17 of the rose 14, whereby a lever arm is provided on the side of the conical segments 13 remote from the door handle entry side and this lever ensures, on insertion of the neck 11 of a door handle with alignment errors, that the inner slide surfaces 41 all stand in full contact with the outer peripheral surface of the rotary spigot 12, whereas the conical outer peripheral surfaces of the conical segments 13 lift partially from the conical inner peripheral surfaces in order to compensate for the alignment error. In this way ring-like gussets 45 are created in this region which are indicated in FIG. 6.

As the axial extensions 19 project rearwardly somewhat beyond the rear surface 17 of the rose a cover and support pot 40 is concentrically mounted concentric to the rear surface 17 of the rose 14, with the peripheral flange of the support pot being flush with the rear surface 17, but projecting however at the center somewhat in the direction of the door leaf where a corresponding recessed guide bore is provided for accommodating the cover and support pot 40. This construction also has the advantage that the rotary spigot 12 of the neck 11 of the door handle is rotationally guided over a greater axial length.

Furthermore the embodiment of FIG. 6 deviates from the previous embodiments in as much as the rotary spigot 12 of the neck 11 of the door handle does not have a reduced diameter relative to the projecting part. The neck 11 of the bore handle thus merges steplessly into the rotary spigot 12 which is supported by the conical segments 13. As a result it is not acceptable for optical reasons and also for contamination reasons to provide the hole 38 in the cover cap 23 for the passage of the door handle with the enlarged diameter necessary to compensate for all errors. On the contrary, the hole 38 for the passage of the door handle has, in the embodiment of FIG. 6, a diameter which just permits contact-free passage of the rotary spigot 12 through the hole 38 for the largest diameter of the rotary spigot 12 which occurs in practice. In order to provide radial compensation for said concentricity and alignment errors the latch surfaces 35 are provided, in accordance with the invention, with sufficient radial play that the entire cover cap 23 obtains a degree of play in the radial direction sufficient to adapt to the concentricity and alignment errors which occur.

For this purpose the latch surfaces 35 have a saw-tooth-like mutual engagement, with ring-like support planes which extend perpendicular to the axis 44 being provided on the rose 14 and on the cover cap 23 respectively. The ring-like support plane on the cover cap 23 has a diameter which is significantly larger than that of the cooperating ring-like support surface on the rose 14. This ensures a radial clearance of the cover cap 23 relative to the rose 14 as indicated at 46 in FIG. 6. In FIG. 6 the cover cap 23 is shown relative to the rose 14 in the right hand end position of the radial play that is available. The ring-like support surfaces which extend parallel to the door leaf must overlap to a sufficient extent that they are still in a reliable latched engagement even with the extreme radial relative displacement shown in FIG. 6.

As seen in FIGS. 7 to 12 the bearing member for the door handle arrangement of the invention is an elongate finger plate 14 which consists of a plastic lower part 14'' and a front metallic cover plate 14'. Specially shaped conical segments 13 are arranged around the central door handle bore 43 and indeed, as in the previous embodiments, four such segments, each at an angle of 90°. The space provided for accommodating the compression coil springs 15 and certain guide parts of the finger plate 14 is extended in the direction of the door leaf behind the rear surface 17 of the finger plate 14 by means of a cover and support pot 40. A corresponding bore is provided in the door leaf (not shown) around the square section bar (again not shown) which in operation connects the door handles on the opposite sides of the door to accommodate the cover and support pot 40.

As seen in FIGS. 9 to 11 each of the conical segments 13, which again extend over an angle of somewhat less than 90°, has a spring accommodating projection 32 at the side facing away from the inner slide surface 41, and this projection 32 contains the axial bore 25 for accommodating the spring 15. The bore 25 is closed at the front and open towards the rear surface 17 of the finger plate 14.

Slide ribs 30 which extend obliquely in accordance with the conical angle of the conical ring gap 16 are formed at both peripheral ends of the spring accommodating projection 32 and have partial peripheral surfaces 27 at the outer side which cooperate with corresponding internal counter surfaces 28 on the finger plate. The partial peripheral surfaces 27 are not curved in the peripheral direction but extend instead parallel to a secant of the door handle bore.

At the radially inner side, opposite to the partial peripheral surfaces 27, the slide ribs 30 likewise have slide surfaces 47 which cooperate with corresponding counter surfaces on the finger plate 14.

As seen in FIGS. 9 to 11 two lubricant receiving bores 33 are provided in the inner slide surface 41. The conical segment 13 of FIGS. 9 and 10 cooperates with a finger plate 14 which apart from the illustration in FIGS. 7 and 8 is particularly clearly shown in FIGS. 12 and 13. As seen in these figures radially outwardly displaced inclined grooves 29 are provided on both sides of each of the right-cylindrical segments 20 which define the largest possible diameter of the door handle bore 43 and which project axially beyond the rear surface 17 of the finger plate 14 clearly into the cover and support pot 40. The slide ribs 30 of FIGS. 9 to 11 engage in a sliding seat in the inclined grooves 29. The inclined grooves 29 extend from the front surface to the rear surface of the finger plate 14 in the sense of a displacement of the conical segments 13 in a radially outward direction.

In the peripheral direction two inclined grooves face one another in each case on a secant. Between each pair of associated confronting inclined grooves 29 there is a radially outwardly projecting free space 31 in which the spring receiving projection 32 of the associated conical segment is accommodated.

As seen in FIGS. 7 and 8 the conical segments 13 are inserted with the slide ribs 30 in the inclined grooves 29 so that they can be displaced along a conical path corresponding to the inclined grooves 29, as in the preceding embodiments, with the actual diameter of the door handle bore 43 which is defined by the inner slide surfaces 41 thereby being changed. The embodiment of FIGS. 7 to 8 has the particular advantage that the conical segments are also guided in troublefree manner in a direction radially towards the inside so that the danger of the conical segments falling out by moving radially inwardly, for example when the door handle has not yet been inserted (FIG. 7) is reliably avoided.

The slide ribs 30 can optionally be journalled with a certain degree of play in the inclined grooves 29 in order to permit a certain degree of tilting of the inclined segments 13, in particular when alignment errors are present.

The part peripheral surfaces 28 (FIG. 8) of the inclined grooves 29 which cooperate with the outer peripheral surfaces 27 of the conical segments 13 are likewise of planar construction and pick up the radial forces exerted by the rotary spigot 12 on the conical segments 13. Self-locking must again exist between the surfaces 27, 28.

As seen in FIGS. 14 and 15 the individual conical segments can also be combined together into a one piece conical ring 13' with a throughgoing appropriately dimensioned radial slot 24 being provided at one peripheral position of the conical ring 13' to permit resilient reduction in size of the conical ring 13'. As seen in FIG. 14 the conical ring 13' is inserted into the conical ring gap 16 of a rose in analogous manner to the conical segments 13, and is biased forwardly by the springs 15.

As can be seen from FIGS. 16 and 17 the conical ring 13' can be provided with lubricant receiving bores 33 around its periphery as seen from the inner slide surface 41.

As the conical ring 13' has not only to be displaced axially but must also wind up axially, in particular when compensating for concentricity and alignment errors it must be appropriately resiliently constructed.

The torsional deflection of the conical ring 13' is facilitated in accordance with FIGS. 18, 19 if it is radially slotted at specific peripheral intervals, with the slots however not passing fully through the ring but leaving small flexible webs 48 at their ends. The axial slots 34 are open at the axially oppositely disposed end. The conical segments 13 are located between the individual axial slots 34 are however connected by the narrow bending webs 48 with the adjacent conical segments into a unitary conical ring 13'. When compared with the arrangement of individual conical segments 13 this embodiment has the advantage that assembly is substantially simplified and that the individual conical segments cannot be easily lost.

Whereas, in the embodiment of FIGS. 18, 19, the axial slots all start from the same end face of the conical ring 13', in the embodiment of FIGS. 20, 21, they alternately start from opposite end faces of the conical ring 13'. This favourably influences the possibility of torsional deflection of the conical ring 30'.

The embodiment of FIGS. 22 and 23 again has a conical ring 13' which consists of conical disks 13'' which are laid flat against one another which are however provisionally held together so that they are movable relative to one another by a rivet 32 which passes axially through them with play. The final assembly takes place after installation when the conical disks are pressed into the conical gap 16 by means of the springs 15. The throughgoing radial slots 24 are in part axially directed, however also displaced in part relative to the one another in the peripheral direction, which is of importance for good guidance of the conical ring 13' within the bearing member 14.

The overall arrangement of the conical disks 13'' again includes spring receiving chambers 25 in which the compression coil springs 15 are accommodated in the same way as in the preceding embodiments.

The arrangement of the conical ring 13' in accordance with FIGS. 22, 23 takes place in the same way as is illustrated in FIG. 14. Torsional deflection of the conical ring 13' of FIGS. 22, 23 when concentricity and alignment errors are present in however facilitated by the subdivision into for example five disks 13" which lie flat against one another. The disks 13" can slide relative to one another in a parallel relative displacement and can also lift from one another to a small degree.

It can be expedient, in particular with a neck 11 of the door handle which has the same diameter up to the rotary spigot 12, to provide apertures 22 in the front surface of the bearing member 14 through which the conical segments 13 can be loaded axially by means of a pin or screwdriver in order to displace them in the direction of the rear surface 17 and to temporally free the rotary spigot 12 of the neck of the door handle in the radial direction. In this way the automatic centering or the automatic positional equalisation of the neck 11 of the door handle can be favourably influenced, or an existing incorrect oblique position or displacement due to lack of concentricity can be corrected.

I claim:

1. A door handle arrangement comprising a bearing member which is to be fastened to a door, the bearing member having a door handle bore; a door handle having a neck including a rotary spigot which extends axially into the bore, the handle being operated by rotating the door handle about the axis of the neck, the bore and the spigot being subject to diameterical tolerance, concentricity errors, and alignment errors; radially movable bearing means arranged between the bearing member and the neck of the door handle to rotationally journal the door handle in the bearing member and compensate for the diametrical tolerances, concentricty errors, or alignment errors, the bearing means comprising one conical segment arranged about the rotary spigot and having a conical, outer surface and an inner surface facing the neck; the bearing member defining a conical inner surface cooperating with the conical outer surface of the segment and extending in an axial direction from a relatively larger diameter end to a relatively smaller diameter end of the handle bore; the outer and inner conical surfaces being arranged to permit movement of the conical segment relative to the door handle bore in radial and axial directions; and spring means operatively disposed between the bearing member and the conical segment and biasing the segment towards the smaller diameter end of the handle bore; the interior surface of the conical segment and an outer peripheral surface of the rotary spigot being in sliding contact with each other.

2. A door handle arrangement comprising a bearing member which is to be fastened to a door, the bearing member having a door handle bore; a door handle having a neck including a rotary spigot which extends axially into the bore, the handle being operated by rotating the door handle about the axis of the neck, the bore and the spigot being subject to diametrical tolerances, concentricity errors and alignment erros; radially movable bearing means arranged between the bearing member and the neck of the door handle to rotationally journal the door handle in the bearing member and compensate for the diametrical tolerances, concentricty errors, or alignment errors, the bearing means comprising conical segments arranged about the rotary spigot, each segment having a conical, outer surface and an inner surface facing the neck; the bearing member defining a conical inner surface cooperating with the conical outer surfaces of the segments and extending in an axial direction from a relatively larger diameter end to a relatively smaller diameter end of the handle bore; the outer and inner conical surfaces beign arranged to permit slidable movement of the conical segments relative to the door handle bore in radial and axial direction; and spring means operatively disposed between the bearing member and the conical segments and biasing the segments towards the smaller diameter end of the handle bore; the interior surfaces of the conical segments and an outer peripheral surface of the rotary spigot being in sliding contact with each other.

3. A door handle arrangement in accordance with claim 2, characterised in that the cone angle and the surface nature of the mutually sliding conical surfaces are so selected that on lack of contact at the internal and external peripheral surfaces the conical segments are just pushed by the preferably weak springs into the conical gap into contact with the inner and outer peripheral surfaces but that the radial forces exerted by the rotary spigot are not able to axially displace the conical segments.

4. A door handle arrangement in accordance with claim 3, characterized in that the cone angle lies between 10° and 20°.

5. A door handle arrangement in accordance with claim 2, characterised in that at least three individual conical segments are uniformly distributed about the periphery.

6. A door handle arrangement in accordance with claim 5, characterised in that each individual conical segment extends over an angle from 40° to 80°.

7. A door handle arrangement in accordance with claim 2, characterised in that one side of the bearing member is adapted to be placed in contact with the door, and in that the larger diameter end of the handle bore is proximate the one side of the bearing member.

8. A door handle arrangement in accordance with claim 7, characterised in that the rotary spigot of the neck of the door handle has a chamber at its entry end face by means of which the conical segments which have been displaced by the spring means to the smaller diameter end of the handle bore can be pressed apart on axial insertion of the rotary spigot to the required diameter.

9. A door handle arrangement in accordance with claim 2, characterised in that the conical segments are of wedge-like tapering shape and each have projecting sliding ribs at both sides in the peripheral direction, with the sliding ribs being flush with the planar outer peripheral surface of the associated segment and slidably engaging complementary inclined grooves which are provided in the radial surfaces provided at the two peripheral sides of the associated conical gap provided to accommodate the respective wedge-like segment.

10. A door handle arrangement in accordance with claim 2, characterised in that the conical segments have an axial extension at the inner surface such that, on the occurrence of alignment errors, the inner surface of the conical segments fully contacts the rotary spigot and the partial lifting of the conical segments brought about by the alignment errors occurs at their outer surfaces.

11. A door handle arrangement in accordance with claim 2, characterised in that the conical segment are axially displaceably journalled on the bearing member and are fixed in a direction.

12. A door handle arrangement in accordance with claim 2, characterised in that fixed segments of the bearing member are provided between the conical segments, the fixed segments being set back somewhat in the radially outward direction.

13. A door handle arrangement in accordance with claim 2, characterised in that axial abutments are provided adjacent the ends of the conical segments remote from the spring means.

14. A door handle arrangement in accordance with claim 2, characterised in that openings are provided in an end face of the bearing member through which the conical segments can be axially loaded and through which the conical segments can be axially displaced when the neck of the door handle is disposed on the bore.

15. A door handle arrangement in accordance with claim 2, characterised in that the rotary spigot and the inner peripheral surfaces of the conical segments are of right-cylindrical shape.

16. A door handle arrangement in accordance with claim 2, characterised in that the conical segments have axially directed blind bores and in that the spring means comprises compression coil springs disposed in the blind bore.

17. A door handle arrangement in accordance with claim 2, characterised in that the spring means are supported at the end which faces axially away from the conical segments on a ring plate mounted at a rear surface of the bearing member.

18. A door handle arrangement in accordance with claim 2, characterised in that the conical segments have partial peripheral surfaces which extend obliquely to the axis solely at their two end regions in the peripheral direction, with each of the part peripheral surfaces cooperating with a corresponding flank of a respective one of two inclined grooves arranged at the side in the bearing part.

19. A door handle arrangement in accordance with claim 18, characterised in that the part peripheral surfaces are formed on sliding ribs disposed at the sides of the conical segments and guided in a sliding seat in the inclined grooves.

20. A door handle arrangment in accordance with claim 19, characterised in that a free space is provided in the bearing member radially outside of each conical segment between the inclined grooves, with a spring accommodating projection of the conical segment being arranged between the sliding ribs extending into the free space.

21. A door handle arrangement in accordance with claim 2, characterised in that the conical segments have bores for grease deposits in the sliding surfaces with bores being formed as blind bores which open towards the rotary spigot.

22. A door handle arrangement in accordance with claim 2, characterised in that the conical segments are combined into a conical ring provided with a radial slot extending over the full axial length of the ring.

23. A door handle arrangement in accordance with claim 22, characterised in that the conical ring is provided with axial slots between adjacent conical segments with the axial slots being open at one end.

24. A door handle arrangement in accordance with claim 23, characterised in that the axial slots are alternately open to the one and to the other end face of the conical ring.

25. A door handle arrangement in accordance with claim 2 comprising a cover cap which covers over the bearing member and which can be snapped into place, with the cover cap having bore for the passage of a door handle in alignment with the door handle bore of the bearing member, and with the rotary spigot at the neck of the door handle having the same diameter as the projecting part of the neck of the door handle, characterised in that the locking surfaces of the cover cap are formed with sufficient radial overlap and are prependicular to the axis in such a way that the cover cap can be radially displaced on the bearing member by the amount required for radial equalisation of the conical segments on the bearing member, with the hole in the cover cap for the passage of the neck of the door handle having a diameter corresponding essentially to the outer diameter of the neck of the door handle or of the rotary spigot.

26. A door handle arrangement in accordance with claim 2, with a cover cap which covers over the bearing member and which can preferably be snapped into place, with the cover cap having a hole for the passage of the door handle in alignment with the door handle bore of the bearing member, and with the rotary spigot of the neck of the door handle having a smaller diameter than the part of the door handle neck which projects axially beyond the bearing member, and merging via a radial shoulder into said part of the door handle neck which projects axially from the bearing member, characterised in that the cover cap is radially fixed on the bearing member and the hole in the cover cap for the passage of the door handle has a larger diameter than the rotary spigot corresponding to the amount required for radial equalisation of the conical segments, with the ring shoulder covering the hole for the passage of the door handle in every possible radial position of the neck of the door handle.

* * * * *